US008872145B2

(12) United States Patent
Hirashita et al.

(10) Patent No.: US 8,872,145 B2
(45) Date of Patent: Oct. 28, 2014

(54) TARGET SUPPLY DEVICE

(71) Applicant: Gigaphoton Inc., Oyama (JP)

(72) Inventors: Toshiyuki Hirashita, Oyama (JP); Toshihiro Nishisaka, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/174,673

(22) Filed: Feb. 6, 2014

(65) Prior Publication Data

US 2014/0217310 A1 Aug. 7, 2014

(30) Foreign Application Priority Data

Feb. 7, 2013 (JP) ..... 2013/022641

(51) Int. Cl.
*G21K 5/08* (2006.01)

(52) U.S. Cl.
CPC ..... *G21K 5/08* (2013.01)
USPC ..... 250/504 R

(58) Field of Classification Search
USPC ..... 250/504 R
See application file for complete search history.

(56) References Cited

U.S. PATENT DOCUMENTS 7,405,416 B2 7/2008 Algots et al.
7,872,245 B2 * 1/2011 Vaschenko et al. ..... 250/492.2

* cited by examiner

*Primary Examiner* — Kiet T Nguyen
(74) *Attorney, Agent, or Firm* — McDermott Will & Emery LLP

(57) ABSTRACT

A target supply device according to an aspect of the present disclosure may include a target generator having a holding space and a first through-hole that communicates with the holding space, a porous filter having a thermal expansion coefficient that is substantially the same as a thermal expansion coefficient of the target generator, and a holder portion having a thermal expansion coefficient that is substantially the same as the thermal expansion coefficient of the target generator, that is configured to hold the porous filter and that is provided so as to form a seal against an inner surface of the target generator.

6 Claims, 13 Drawing Sheets

TARGET SUPPLY DEVICE

CROSS-REFERENCE TO A RELATED APPLICATION

The present application claims priority from Japanese Patent Application No. 2013-022641, filed Feb. 7, 2013.

BACKGROUND

1. Technical Field

The present disclosure relates to target supply devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to an aspect of the present disclosure may include a target generator, a porous filter, and a holder portion. The target generator may have a holding space and a first through-hole that communicates with the holding space. The porous filter may have a thermal expansion coefficient that is substantially the same as a thermal expansion coefficient of the target generator. The holder portion may have a thermal expansion coefficient that is substantially the same as the thermal expansion coefficient of the target generator, may be configured to hold the porous filter, and may be provided so as to form a seal against an inner surface of the target generator.

BRIEF DESCRIPTION OF THE DRAWINGS

Hereinafter, selected embodiments of the present disclosure will be described with reference to the accompanying drawings.

DETAILED DESCRIPTION

Figure 1:
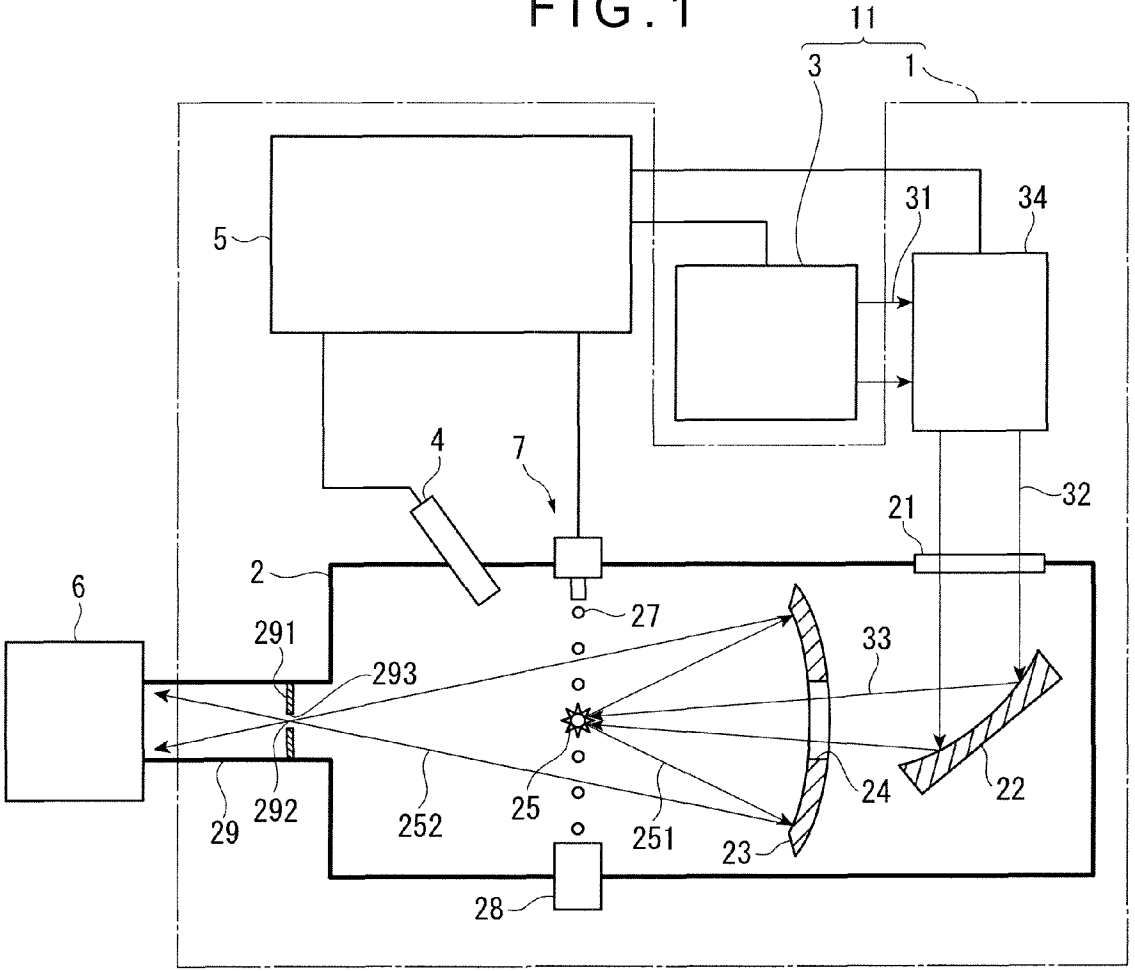
FIG. 1 schematically illustrates an exemplary configuration of an EUV light generation apparatus.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. EUV Light Generation Apparatus Including Target Supply Device
3.1 Terms
3.2 First Embodiment
3.2.1 Configuration
3.2.2 Operation
3.2.2.1 Assembly of Target Generator
3.2.2.2 Operation of Target Supply Device
3.3 Second Embodiment
3.3.1 Overview
3.3.2 Configuration
3.3.3 Operation
3.4 Third Embodiment
3.4.1 Overview
3.4.2 Configuration
3.4.3 Operation
3.4.3.1 Assembly of Target Generator
3.4.3.2 Operation of Target Supply Device
3.5 Fourth Embodiment
3.5.1 Overview
3.5.2 Configuration
3.5.3 Operation
3.6 Fifth Embodiment
3.6.1 Configuration
3.6.2 Operation
3.7 Variations 1. Overview According to an embodiment of the present disclosure, a target supply device may include a target generator, a porous filter, and a holder portion. The target generator may have a holding space and a first through-hole that communicates with the holding space. The porous filter may have a thermal expansion coefficient that is substantially the same as a thermal expansion coefficient of the target generator. The holder portion may have a thermal expansion coefficient that is substantially the same as the thermal expansion coefficient of the target generator, may be configured to hold the porous filter, and may be provided so as to form a seal against an inner surface of the target generator.

2. Overview of EUV Light Generation System 2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Target Supply Device 3.1. Terms

Hereinafter, aside from descriptions that refer to FIG. 1, there are cases where directions will be described based on XYZ axes illustrated in the drawings.

Note that these expressions do not express relationships with a gravitational direction 10B.

3.2 First Embodiment 3.2.1 Configuration

Figure 2:
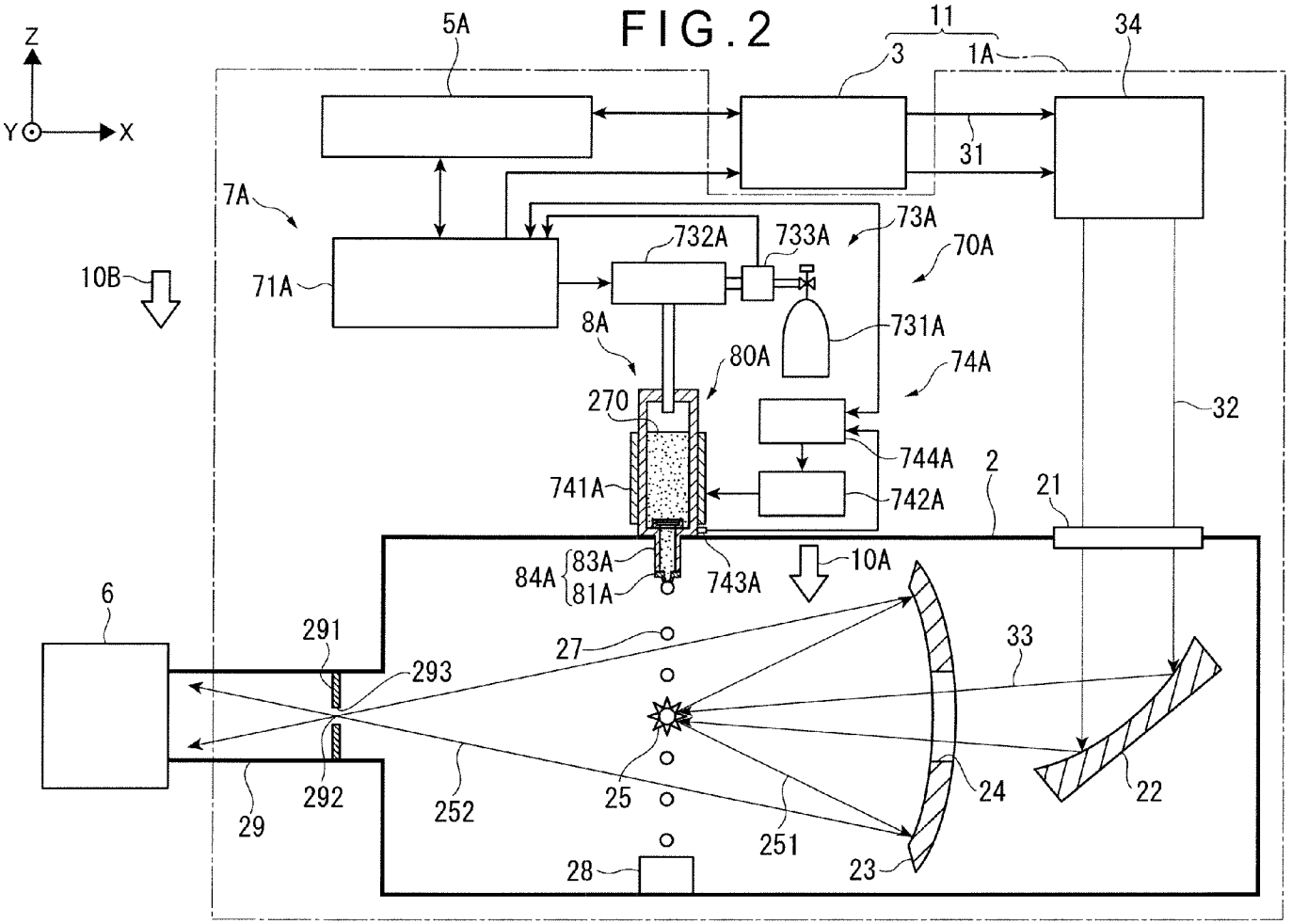
FIG. 2 illustrates the overall configuration of an EUV light generation apparatus that includes a target supply device according to a first embodiment.
Figure 3:
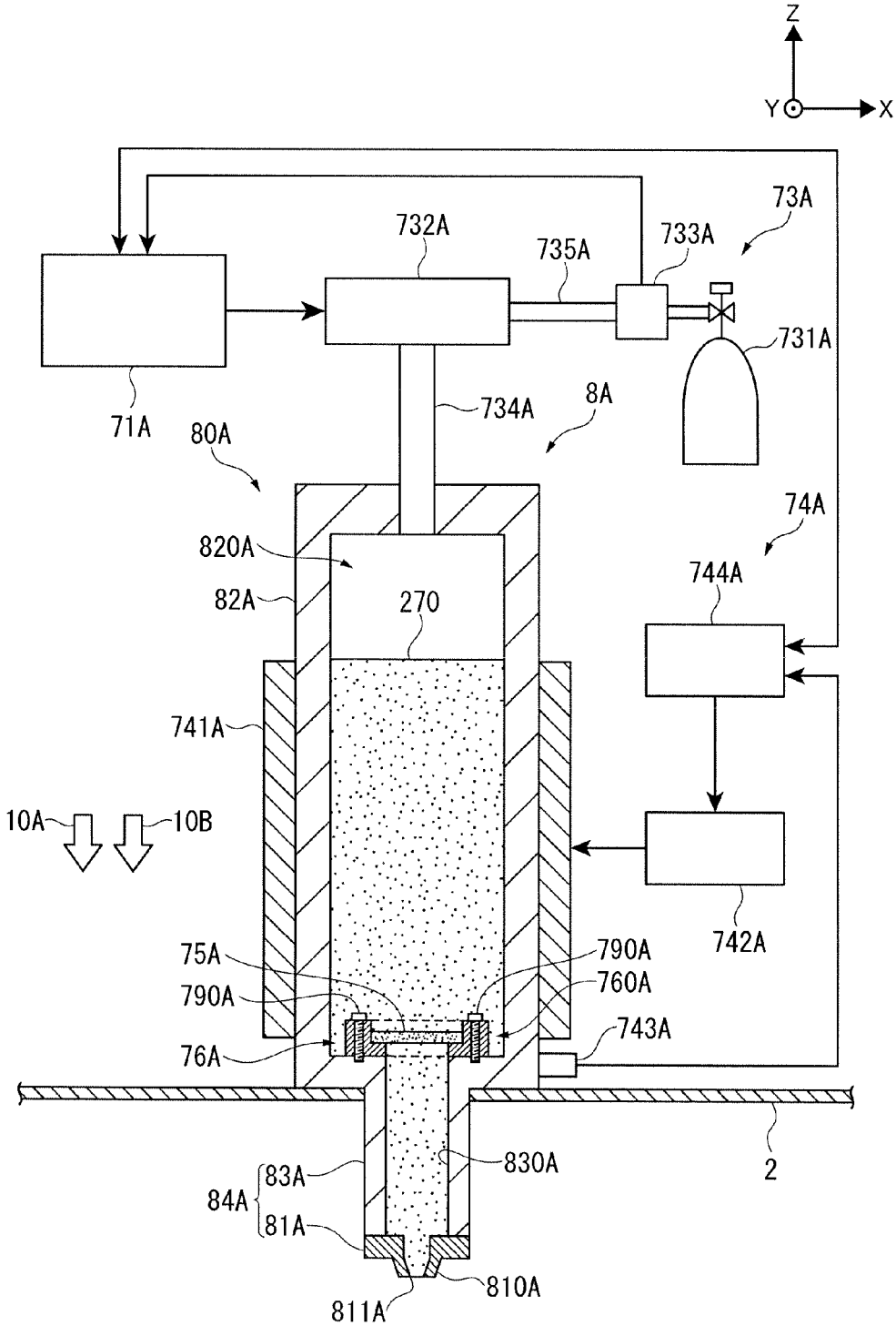
FIG. 3 illustrates the overall configuration of a target supply device.
Figure 4A:
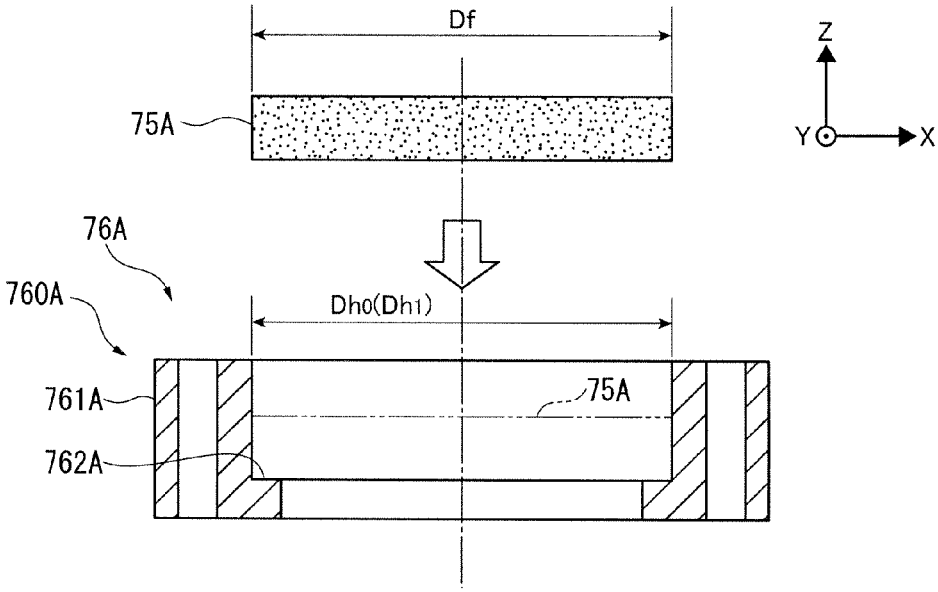
FIG. 4A illustrates operations performed when attaching a porous filter to a holder portion.
Figure 4B:
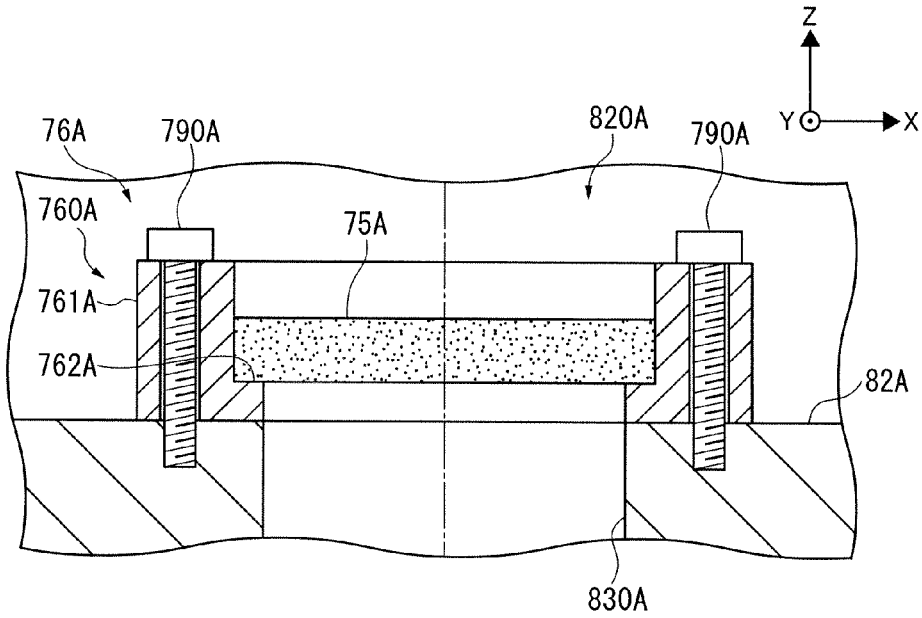
FIG. 4B illustrates a state occurring after a porous filter and a holder portion have been attached to a target generator.

FIG. 2 illustrates the overall configuration of an EUV light generation apparatus that includes a target supply device according to a first embodiment. FIG. 3 illustrates the overall configuration of the target supply device. FIG. 4A illustrates operations performed when attaching a porous filter to a holder portion. FIG. 4B illustrates a state occurring after the porous filter and the holder portion have been attached to the target generator.

An EUV light generation apparatus 1A may, as shown in FIG. 2, include the chamber 2 and a target supply device 7A. The target supply device 7A may include a target generation section 70A and a target control apparatus 71A. The laser apparatus 3 and an EUV light generation controller 5A may be electrically connected to the target control apparatus 71A.

As shown in FIGS. 2 and 3, the target generation section 70A may include a target generator 8A, a pressure control section 73A, a temperature control section 74A, a porous filter 75A, and a holder portion 76A.

The target generator 8A may include a generator main body 80A and a nozzle tip portion 81A. The generator main body 80A may include a tank 82A formed in a substantially cylindrical shape and having wall surfaces in a first surface located on a +Z direction side and a second surface located on a −Z direction side. A hollow portion of the tank 82A may serve as a holding space 820A for holding a target material 270. An inner surface of the tank 82A on which the holder portion 76A is provided may be polished.

A nozzle main body 83A may be provided to the tank 82A. The nozzle main body 83A may be formed in a substantially cylindrical shape extending in the −Z direction from the center of the second surface of the tank 82A. A hollow portion of the nozzle main body 83A may serve as a first through-hole 830A for conveying the target material 270 within the holding space 820A to the nozzle tip portion 81A. The nozzle main body 83A and the nozzle tip portion 81A may configure a nozzle 84A disposed so that the first through-hole 830A and the holding space 820A communicate. The nozzle 84A may be provided so as to protrude into the chamber 2 from the second surface of the tank 82A.

The nozzle tip portion 81A may be formed as a substantially circular plate. An outer diameter of the nozzle tip portion 81A may be substantially the same as an outer diameter of the nozzle main body 83A. The nozzle tip portion 81A may be provided so as to be flush against an end surface of the nozzle main body 83A on the −Z direction side thereof. A truncated cone-shaped protruding portion 810A may be provided in a central area of the nozzle tip portion 81A. The protruding portion 810A may be provided so as to make it easier for an electrical field to concentrate thereon in the case where the targets 27 are generated using static electricity. A nozzle hole 811A may be provided in the protruding portion 810A. The nozzle hole 811A may be provided in substantially the center of an end portion of the protruding portion 810A on the −Z direction side thereof. The diameter of the nozzle hole 811A may be 6 μm to 15 μm.

It is preferable for the nozzle tip portion 81A to be configured of a material that achieves an angle of contact of greater than or equal to 90° between the nozzle tip portion 81A and the target material 270. Alternatively, at least the surface of the nozzle tip portion 81A may be coated with a material whose stated angle of contact is greater than or equal to 90°. For example, in the case where the target material 270 is tin, the material having an angle of contact of greater than or equal to 90° may be SiC, $SiO_2$, $Al_2O_2$, molybdenum, tungsten, or the like.

The generator main body 80A and the nozzle tip portion 81A may be configured of electrically insulated materials. In the case where these elements are configured of materials that are not electrically insulated materials, for example, metal materials such as molybdenum, an electrically insulated material may be disposed between the chamber 2 and the target generator 8A.

Depending on how the chamber 2 is arranged, a pre-set output direction for the targets 27 may be an axial direction of the nozzle 84A, for example, and will be referred to as a set output direction 10A. It is not necessarily the case that the set output direction 10A will match the gravitational direction 10B. The configuration may be such that the targets 27 are outputted at an angle relative to the gravitational direction 10B. Note that in the first embodiment, the chamber 2 may be arranged so that the set output direction 10A and the gravitational direction 10B match.

The pressure control section 73A may include an actuator 732A and a pressure sensor 733A. The actuator 732A may be linked to a first end portion of the tank 82A on the +Z direction side thereof via a pipe 734A. The actuator 732A may be connected to an inert gas bottle 731A via a pipe 735A. The actuator 732A may be electrically connected to the target control apparatus 71A. The actuator 732A may be configured to adjust a pressure within the tank 82A by controlling the pressure of an inert gas supplied from the inert gas bottle 731A based on a signal sent from the target control apparatus 71A.

The pressure sensor 733A may be provided in the pipe 735A. The pressure sensor 733A may be electrically connected to the target control apparatus 71A. The pressure sensor 733A may detect a pressure of the inert gas present in the pipe 735A and may send a signal corresponding to the detected pressure to the target control apparatus 71A. Alternatively, the pressure sensor 733A may be provided in the pipe 734A, and may be configured to detect a pressure of the inert gas present in the pipe 734A and send a signal corresponding to the detected pressure to the target control apparatus 71A.

The temperature control section 74A may be configured to control the temperature of the target material 270 within the tank 82A. The temperature control section 74A may include a heater 741A, a heater power source 742A, a temperature sensor 743A, and a temperature controller 744A.

The heater 741A may be provided on an outer circumferential surface of the tank 82A.

The heater power source 742A may cause the heater 741A to produce heat by supplying power to the heater 741A based on a signal from the temperature controller 744A. As a result, the target material 270 within the tank 82A can be heated via the tank 82A.

The temperature sensor 743A may be provided on the outer circumferential surface of the tank 82A, toward the location of the nozzle 84A, or may be provided within the tank 82A. The temperature sensor 743A may be configured to detect a temperature primarily at a location where the temperature sensor 743A is installed as well as the vicinity thereof in the tank 82A, and to send a signal corresponding to the detected temperature to the temperature controller 744A. The temperature at the location where the temperature sensor 743A is installed and at the vicinity thereof can be substantially the same temperature as the temperature of the target material 270 within the tank 82A.

The temperature controller 744A may be configured to output, to the heater power source 742A, a signal for controlling the temperature of the target material 270 to a predetermined temperature, based on a signal from the temperature sensor 743A.

The target material 270 may contain particles. The particles can be produced by the target material 270 reacting with impurities or oxygen, or can be contained in the raw material of the target material 270, or can be produced by physical abrasion between the target material 270 and the tank 82A. The porous filter 75A may be created from a porous material in order to collect the particles contained in the target material 270. The porous filter 75A may be formed as a substantially circular plate, and a diameter thereof may be greater than an inner diameter of the first through-hole 830A. The porous filter 75A may be held within the holding space 820A by the holder portion 76A so as to face an opening of the first through-hole 830A on the +Z direction side thereof.

The porous filter 75A may be formed of a material having a low reactivity with the target material 270. A difference between the coefficient of linear thermal expansion of the porous filter 75A and the coefficient of linear thermal expansion of the tank 82A may be lower than 20% of the coefficient of linear thermal expansion of the tank 82A. A difference between the coefficient of linear thermal expansion of the porous filter 75A and the coefficient of linear thermal expansion of a main body member 760A (mentioned later) of the holder portion 76A may be lower than 20% of the coefficient of linear thermal expansion of the main body member 760A. A difference between the coefficient of linear thermal expansion of the porous filter 75A and the coefficient of linear thermal expansion of bolts 790A may be lower than 20% of the coefficient of linear thermal expansion of the bolts 790A.

In the case where the target material 270 is tin, the target generator 8A, the main body member 760A, and the bolts 790A may be formed of molybdenum, which has a low reactivity with tin. In the case where the target generator 8A, the main body member 760A, and the bolts 790A are formed of molybdenum or tungsten, the porous filter 75A may be formed of any one of the materials indicated below in Table 1. The coefficient of linear thermal expansion of molybdenum is $5.2\times10^{-6}$. The coefficient of linear thermal expansion of tungsten is $4.6\times10^{-6}$.

TABLE 1

| Porous Filter Type | Porous Filter Structure | Material | Coefficient of Linear Thermal Expansion ($\times10^{-6}$) |
|---|---|---|---|
| glass porous filter | porous glass | aluminum oxide/silicon dioxide glass | 6.0 |
| ceramic porous filter | porous ceramics | silicon carbide | 4.1 |
| | | tungsten carbide | 5.2 |
| | | aluminum nitride | 4.8 |
| | | zirconium boride | 5.9 |
| | | boron carbide | 5.4 |

The material of the porous filter 75A may, for example, be shirasu porous glass (SPG) provided by SPG Technology Co., Ltd. SPG may be a porous glass that employs volcanic ash (shirasu) as a raw material. In the case where SPG is used as a material, the porous filter 75A may be formed as a substantially circular plate, and for example, a thickness dimension (a dimension in a Z-axis direction) of the porous filter 75A may be approximately 3 mm, whereas a diameter of the porous filter 75A may be approximately 20 mm.

Component percentages of SPG may be the ratios indicated below in Table 2.

TABLE 2

| | Component | | | | | | |
|---|---|---|---|---|---|---|---|
| | $SiO_2$ | $B_2O_3$ | $Al_2O_3$ | $NA_2O$ | CaO | MgO | $K_2O$ |
| Percentage | 58 | 9 | 11 | 8 | 4 | 3 | 3 |

As a method for manufacturing SPG, first, shirasu, lime, and boric acid are mixed and heated to a temperature of around 1350° C., thus synthesizing and forming an SPG base glass. The base glass is then heated to 650° C. to 750° C. This heating causes phase separation, resulting in CaO—$B_2O_3$ (calcium oxide-boron trioxide). The base glass is then heated to 50° C. to 90° C. and is subjected to acid treatment using hydrochloric acid, for example. CaO—$B_2O_3$ is eluted as a result of the acid treatment, and the SPG is completed, with the $Al_2O_2$—$SiO_2$ (aluminum oxide-silicon dioxide) glass that does not dissolve in the acid as a main material.

In the case where SPG is used as the material, countless fine holes having diameters of greater than or equal to 6 μm and less than or equal to 20 μm and that curve in a variety of directions can be provided in the porous filter 75A.

As shown in FIGS. 4A and 4B, the holder portion 76A may include the main body member 760A and a plurality of bolts 790A serving as anchoring portions. The main body member 760A and the bolts 790A may be formed of a material having a low reactivity with the target material 270. For example, in the case where the target material 270 is tin, the main body member 760A and the bolts 790A may be formed of molybdenum.

The main body member 760A may include a cylinder portion 761A having a substantially cylindrical shape. An outer diameter and an inner diameter of the cylinder portion 761A may be greater than an inner diameter of the first through-hole 830A. A contact portion 762A that projects toward the inside of the cylinder portion 761A may be provided in a second end of the cylinder portion 761A on the −Z direction side thereof. The contact portion 762A may be formed in a substantially circular ring-shape. An inner diameter of the contact portion 762A may be substantially the same as the inner diameter of the first through-hole 830A. A second surface of the main body member 760A on the −Z direction side thereof, an inner surface of the cylinder portion 761A, and a first surface of the contact portion 762A on the +Z direction side thereof may be polished.

The main body member 760A may be provided so that the contact portion 762A surrounds the opening of the first through-hole 830A. The contact portion 762A may be positioned between the porous filter 75A and the second surface of the tank 82A. The porous filter 75A may be disposed in the cylinder portion 761A so as to make contact with the contact portion 762A.

The bolts 790A may pass through the cylinder portion 761A in an axial direction of the cylinder portion 761A (the Z-axis direction) and be screwed into the tank 82A.

The target control apparatus 71A may control the temperature of the target material 270 in the target generator 8A by sending a signal to the temperature controller 744A. The target control apparatus 71A may control a pressure in the target generator 8A by sending a signal to the actuator 732A of the pressure control section 73A.

3.2.2 Operation 3.2.2.1 Assembly of Target Generator

In the case where the diameter of the porous filter 75A at a normal temperature (for example, 23° C.) is represented by Df, the inner diameter of the main body member 760A at a normal temperature is represented by Dh0, and the inner diameter of the main body member 760A at a high temperature (for example, 400° C.) is represented by Dh1, Df, Dh0, and Dh1 may be in relationships that fulfill the following Formulas (1) and (2).

$$Dh0<Df \quad (1)$$

$$Dh1>Df \quad (2)$$

The main body member 760A may be heated to 400° C., for example. When the main body member 760A is heated, the inner diameter of the main body member 760A can change from Dh0, which is smaller than Df, to Dh1, which is greater than Df. In this state, the porous filter 75A at a normal temperature may be inserted into the main body member 760A, as indicated by the double-dot-dash line in FIG. 4A. A second surface of the porous filter 75A on the −Z direction side thereof may make contact with the first surface of the contact portion 762A.

Thereafter, the main body member 760A into which the porous filter 75A has been inserted may be cooled to a normal temperature. When the main body member 760A is cooled, the inner diameter of the main body member 760A can change from Dh1 to Dh0, and the second surface of the porous filter 75A can be sealed flush against the first surface of the contact portion 762A. Likewise, aside surface of the porous filter 75A can be sealed flush against the inner surface of the cylinder portion 761A.

As shown in FIG. 4B, the main body member 760A into which the porous filter 75A has been inserted may be disposed in the tank 82A so that the contact portion 762A surrounds the opening of the first through-hole 830A. Thereafter, the bolts 790A may be screwed into the tank 82A.

By screwing the bolts 790A into the tank 82A in this manner, the main body member 760A can be anchored to the target generator 8A with a seal being formed between the tank 82A and the second surface of the main body member 760A.

3.2.2.2 Operation of Target Supply Device

Figure 5A:
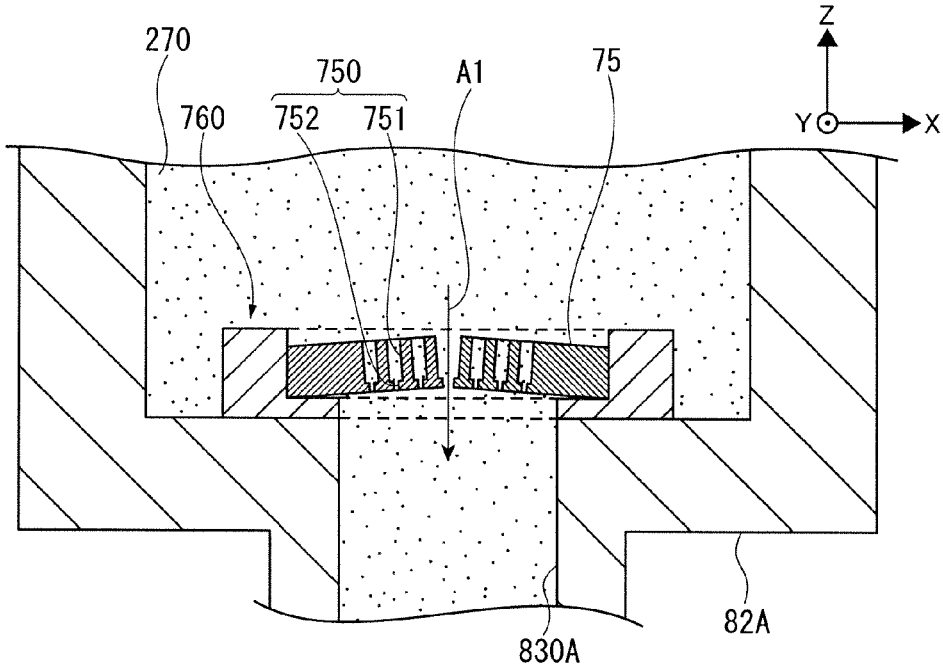
FIG. 5A illustrates a state when a target supply device is heating a target generator in order to generate targets.
Figure 5B:
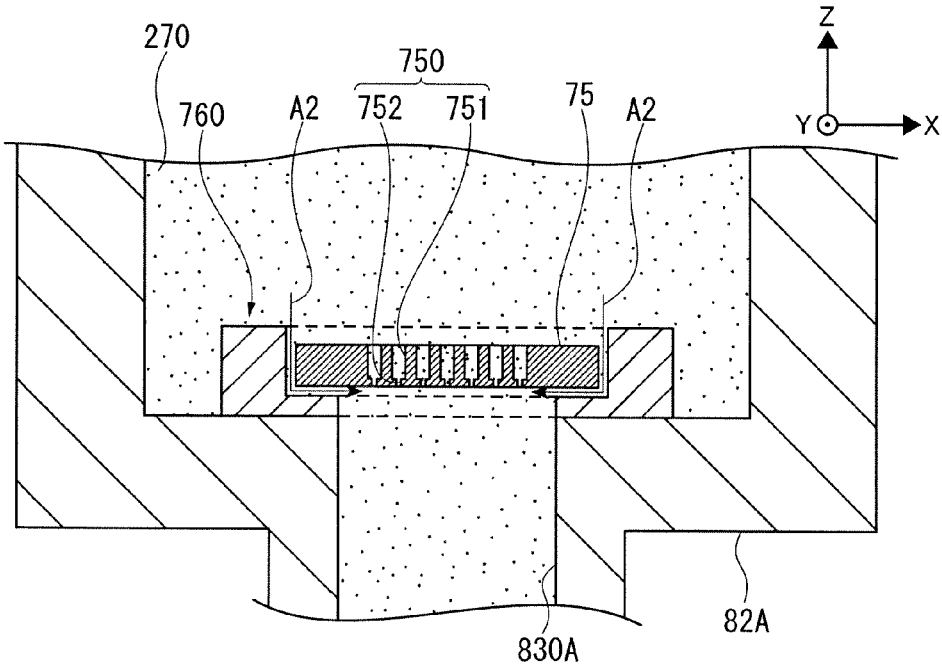
FIG. 5B illustrates a state when a target supply device is heating a target generator in order to generate targets.

FIGS. 5A and 5B illustrate a state when the target supply device is heating the target generator in order to generate targets.

Note that the following describes operations performed by the target supply device 7A using a case where the target material 270 is tin as an example.

As shown in FIG. 5A, a porous filter 75 and a main body member 760 may be provided in the tank 82A of the target supply device. In the case where a difference between the coefficient of linear thermal expansion of the porous filter 75 and the coefficient of linear thermal expansion of the main body member 760 is greater than 20% of the coefficient of linear thermal expansion of the main body member 760, or in the case where a difference between the coefficient of linear thermal expansion of the porous filter 75 and the coefficient of linear thermal expansion of the tank 82A is greater than 20% of the coefficient of linear thermal expansion of the tank 82A, the porous filter 75 may break during the process of heating the target material 270 to a temperature greater than or equal to a melting point of the target material 270. As a result, the target material 270 may pass through the broken area and enter into the first through-hole 830A, as indicated by an arrow A1. Alternatively, a gap may form in a sealed surface between the porous filter 75 and the main body member 760 during the process of heating the target material 270 to a temperature greater than or equal to the melting point of the target material 270, as indicated in FIG. 5B. As a result, liquid target material 270 may leak into the first through-hole 830A without passing through the porous filter 75, as indicated by an arrow A2.

In the case where a mechanical processing unit or an electrical discharge processing unit is used to form through-holes 750 in the porous filter 75, there may be a limit to the number of through-holes 750, and with the through-holes 750 being formed in an substantially straight line in the depth direction thereof, there may be a limit on the depth dimensions of the through-holes 750.

Such a limit on the depth dimensions, number, and so on of the through-holes 750 may in turn result in a limit on the amount of particles collected, or in other words, a limit on the capacity.

However, according to the first embodiment, the porous filter 75A can be suppressed from breaking when the target generator 8A and the main body member 760A are heated to a temperature greater than or equal to the melting point of the target material 270. In addition, the target material 270 can be suppressed from leaking into the first through-hole 830A without passing through the porous filter 75A. Furthermore, the amount of particles collected by the porous filter 75A can be greater than the amount collected by the porous filter 75.

3.3 Second Embodiment 3.3.1 Overview

In a target supply device according to a second embodiment of the present disclosure, the porous filter may be held by the holder portion so as to oppose an opening of the first through-hole within the holding space, and the holder portion may include a first member provided between the porous filter and the target generator so as to surround the opening of the first through-hole, a shim that is stacked upon the porous filter, a second member provided so as to sandwich the porous filter and the shim between the first member and the second member, and an anchoring portion that anchors the first member, the second member, and the target generator together.

3.3.2 Configuration

Figure 6A:
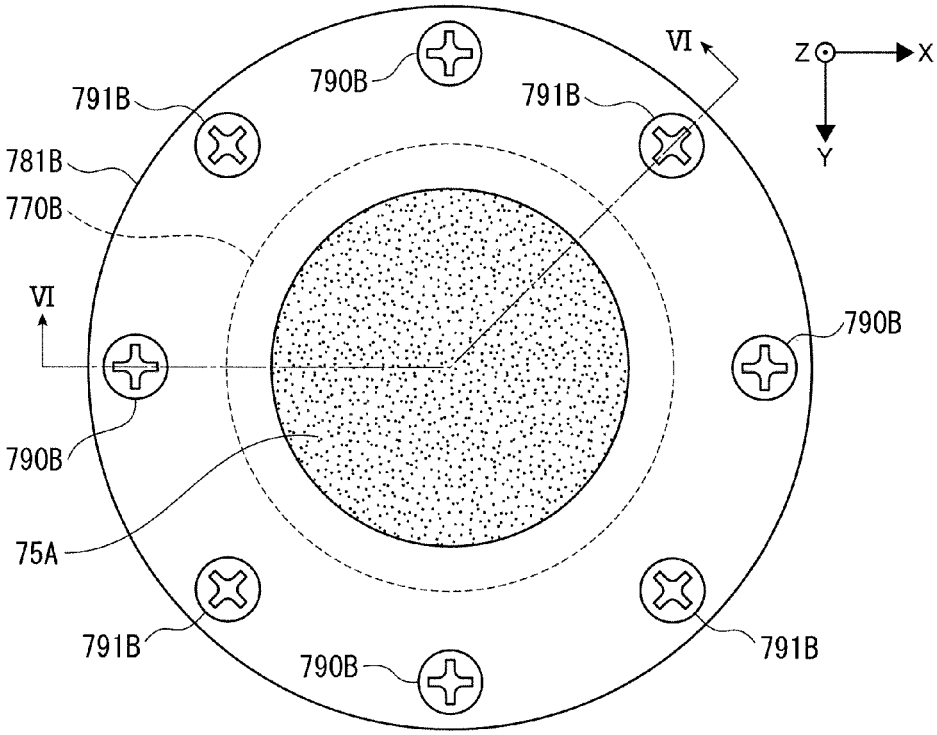
FIG. 6A schematically illustrates the configuration of primary components of a target supply device according to a second embodiment, as viewed from a +Z direction.
Figure 6B:
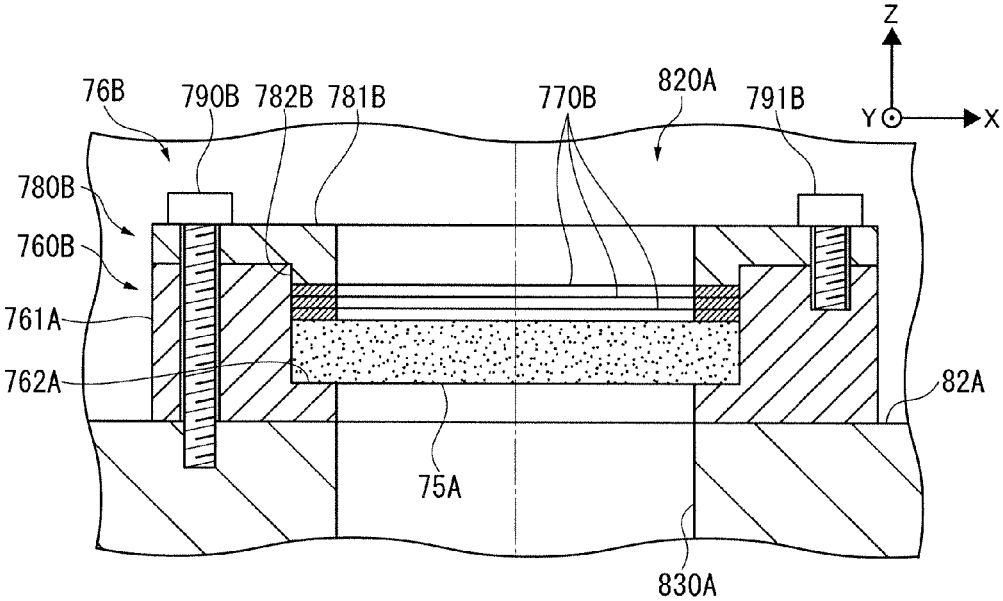
FIG. 6B is a cross-sectional view taken along a VI-VI line shown in FIG. 6A.

FIG. 6A schematically illustrates the configuration of primary components of a target supply device according to the second embodiment, as viewed from the +Z direction. FIG. 6B is a cross-sectional view taken along a VI-VI line shown in FIG. 6A.

The target supply device according to the second embodiment may have the same configuration as the target supply device 7A according to the first embodiment, with the exception of a holder portion 76B.

As indicated in FIGS. 6A and 6B, the holder portion 76B may include a main body member 760B serving as a first member, shims 770B, a pressing member 780B serving as a second member, and bolts 790B and 791B serving as anchoring portions.

The main body member 760B may include the cylinder portion 761A. A first surface of the cylinder portion 761A on the +Z direction side thereof may be polished. The contact portion 762A may be provided in the cylinder portion 761A.

The shims 770B and the pressing member 780B may be formed of a material having a low reactivity with the target material 270. A difference between the coefficient of linear thermal expansion of the porous filter 75A and the coefficient of linear thermal expansion of the shims 770B may be lower than 20% of the coefficient of linear thermal expansion of the shims 770B. A difference between the coefficient of linear thermal expansion of the porous filter 75A and the coefficient of linear thermal expansion of the pressing member 780B may be lower than 20% of the coefficient of linear thermal expansion of the pressing member 780B. A difference between the coefficient of linear thermal expansion of the porous filter 75A and the coefficient of linear thermal expansion of the target generator 8A may be lower than 20% of the coefficient of linear thermal expansion of the target generator 8A. For example, in the case where the porous filter 75A is an SPG porous filter and the target material 270 is tin, the shims 770B and the pressing member 780B may be formed of molybdenum. Note that the shims 770B and the pressing member 780B may be formed of different materials.

The shims 770B may be formed as substantially ring-shaped plates. An outer diameter of the shims 770B may be approximately 20 mm, for example, and may be substantially the same as an inner diameter of the cylinder portion 761A. An inner diameter of the shims 770B may be substantially the same as the inner diameter of the contact portion 762A. A first surface of the shims 770B on the +Z direction side thereof and a second surface on the −Z direction side thereof may be polished.

The shims 770B may be stacked upon a first surface of the porous filter 75A on the +Z direction side thereof within the main body member 760B. Three shims 770B, for example, may be stacked within the main body member 760B. In the case where a plurality of shims 770B are used, the thicknesses thereof may be the same or may be different.

The pressing member 780B may include a ring-shaped plate portion 781B that is larger than the shims 770B. An outer diameter of the ring-shaped plate portion 781B may be substantially the same as the outer diameter of the cylinder portion 761A. An inner diameter of the ring-shaped plate portion 781B may be substantially the same as the inner diameter of the contact portion 762A. A contact portion 782B may be provided in the ring-shaped plate portion 781B. The contact portion 782B may be provided so as to project in the −Z direction from an inner side of the ring-shaped plate portion 781B. The contact portion 782B may be formed in a substantially circular ring-shape. An outer diameter of the contact portion 782B may be substantially the same as the inner diameter of the cylinder portion 761A. A second surface of the ring-shaped plate portion 781B and the contact portion 782B on the −Z direction side thereof may be polished.

The pressing member 780B may be provided so that the contact portion 782B is inserted into the cylinder portion 761A and makes contact with the first surface of the shims 770B and so that the second surface of the ring-shaped plate portion 781B makes contact with the first surface of the cylinder portion 761A.

The bolts 790B may have a length that enables the bolts 790B to pass through the ring-shaped plate portion 781B and the cylinder portion 761A. The bolts 791B may have a length that enables the bolts 791B to pass through the ring-shaped plate portion 781B but not the cylinder portion 761A. The bolts 790B may pass through the ring-shaped plate portion 781B and the cylinder portion 761A and be screwed into the tank 82A. The bolts 791B may pass through the ring-shaped plate portion 781B and be screwed into the cylinder portion 761A.

3.3.3 Operation

Next, operations for assembling the target generator will be described.

In the following, descriptions of operations identical to those in the first embodiment will be omitted.

Note also that because operations performed when generating EUV light are the same as those in the first embodiment, descriptions thereof will be omitted.

First, after the porous filter 75A has been inserted into the main body member 760B, the three shims 770B may be stacked upon the porous filter 75A. Then, the pressing member 780B may be inserted into the main body member 760B. The presence of a gap between the ring-shaped plate portion 781B and the cylinder portion 761A or a gap between the opposing surfaces of the contact portion 782B and the shims 770B may be checked at this time. In the case where the presence of either of these gaps has been confirmed, the shims 770B that are disposed may be changed to shims having different thicknesses. The gaps may be eliminated by adjusting the thicknesses of the shims 770B. In the case where a plurality of shims 770B are used, the total thickness thereof may be adjusted in order to eliminate the gap. Through this, contact pressure between the main body member 760B and the porous filter 75A and between the pressing member 780B and the porous filter 75A may be adjusted. Thereafter, the bolts 791B may be screwed into the cylinder portion 761A.

The pressing member 780B, the shims 770B, and the porous filter 75A can be anchored to the main body member 760B by screwing the bolts 791B into the cylinder portion 761A in this manner. At this time, a seal can be formed between the first surface of the contact portion 762A and the second surface of the porous filter 75A, and between a first surface of the porous filter 75A and a second surface of the lowermost shim 770B. In addition, a seal can be formed between the shims 770B stacked on each other, between the first surface of the uppermost shim 770B and a second surface of the contact portion 782B, and between the first surface of the cylinder portion 761A and the second surface of the ring-shaped plate portion 781B.

Thereafter, the main body member 760B may be placed on the tank 82A and the bolts 790B may be screwed into the tank 82A.

The main body member 760B can be anchored to the target generator 8A by screwing the bolts 791B into the tank 82A in this manner.

According to the second embodiment described thus far, the shims 770B are provided between the porous filter 75A and the pressing member 780B, and thus the contact pressure between the main body member 760B and the porous filter 75A and between the pressing member 780B and the porous filter 75A can be adjusted with ease.

3.4 Third Embodiment

3.4.1 Overview

A target supply device according to a third embodiment of the present disclosure may include a filter. The filter may have a thermal expansion coefficient that is substantially the same as the thermal expansion coefficient of the target generator, and may be provided so as to suppress foreign objects from entering the first through-hole on the opposite side of the porous filter to the side on which the holding space is located.

In the target supply device according to the third embodiment of the present disclosure, the target generator may include a tank having the holding space and a second through-hole that partially configures the first through-hole, a nozzle base end portion, having a third through-hole that partially configures the first through-hole, that is attached to the tank, and a nozzle tip portion, having a fourth through-hole that partially configures the first through-hole, that is attached to the nozzle base end portion. The porous filter may be held by the holder portion within the third through-hole. The holder portion may include a main body member, formed in an substantially cylindrical shape so as to fit with the third through-hole and internally house the porous filter, having a contact portion that makes contact with the porous filter on the side of the porous filter located toward the fourth through-hole, a shim that is stacked upon the porous filter on the side of the porous filter located toward the second through-hole, and an anchoring portion that anchors the nozzle base end portion to the tank.

3.4.2 Configuration

Figure 7:
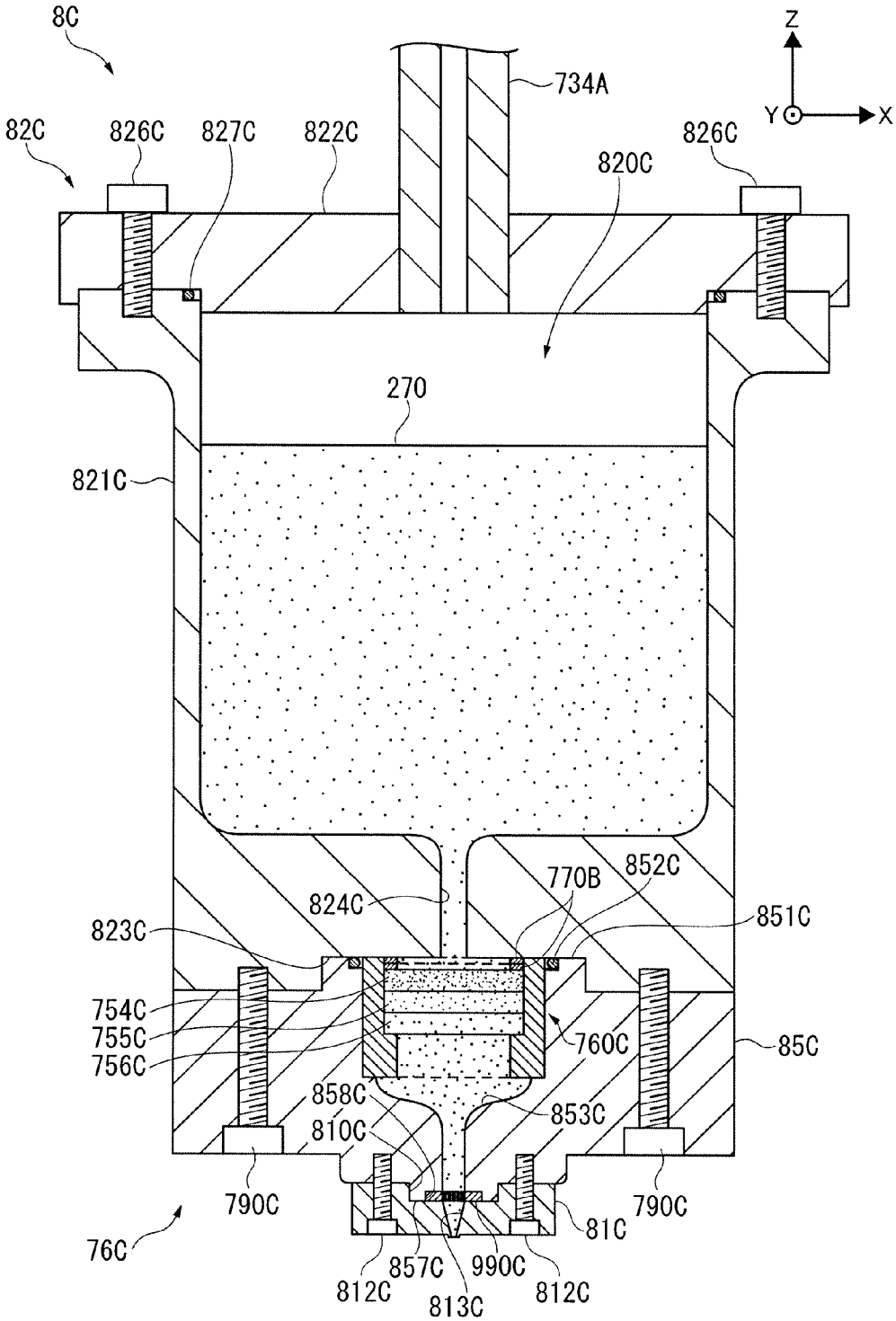
FIG. 7 schematically illustrates the configuration of a target supply device according to a third embodiment.
Figure 8:
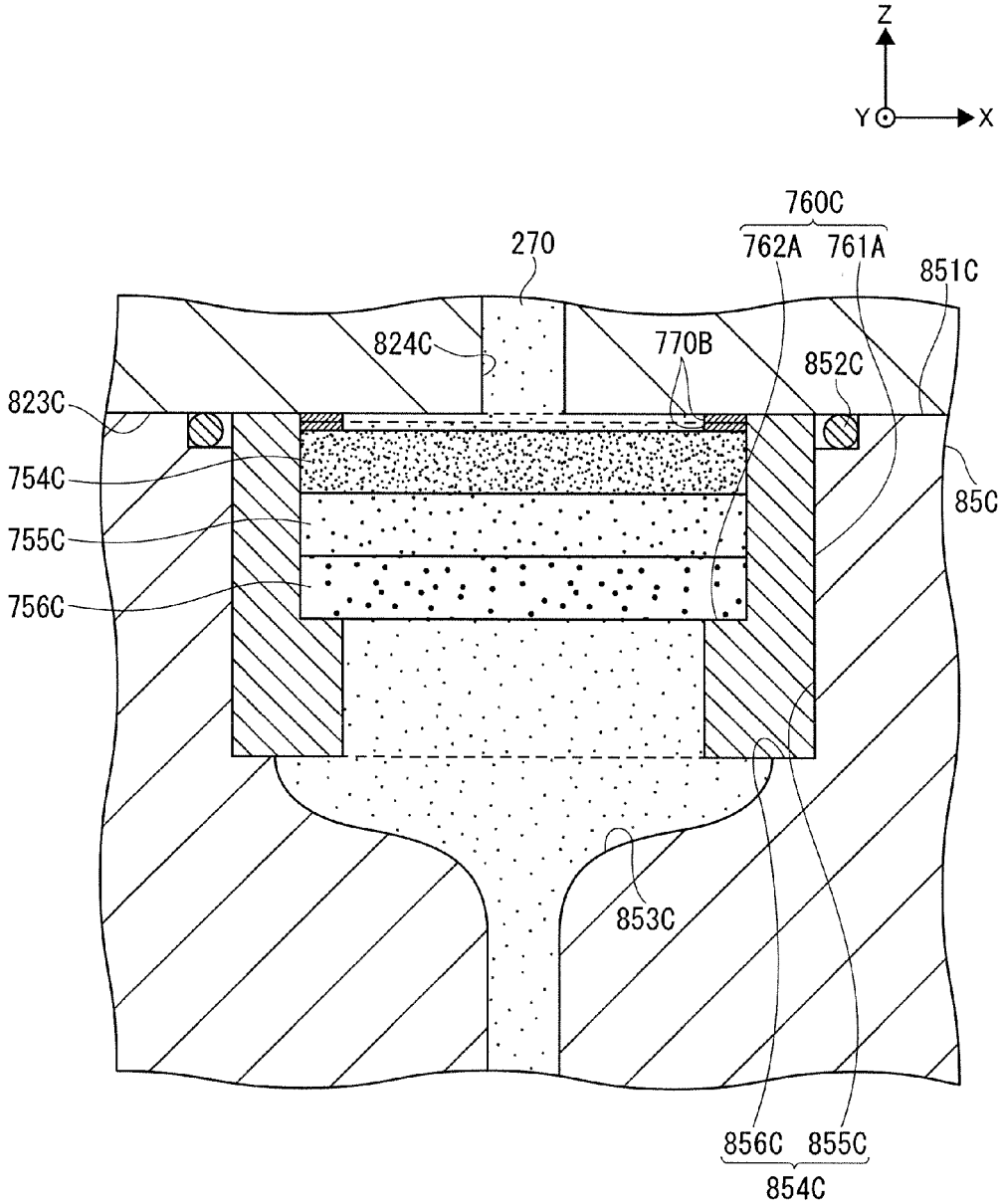
FIG. 8 illustrates a state of attachment of first, second, and third porous filters in a target supply device.
Figure 9A:
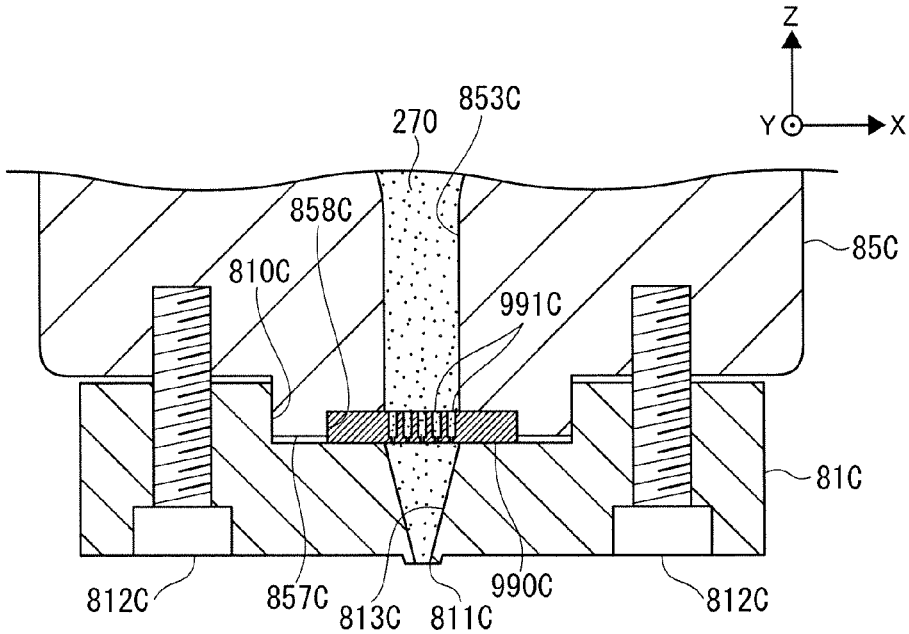
FIG. 9A illustrates a state of attachment of a filter in a target supply device.
Figure 9B:
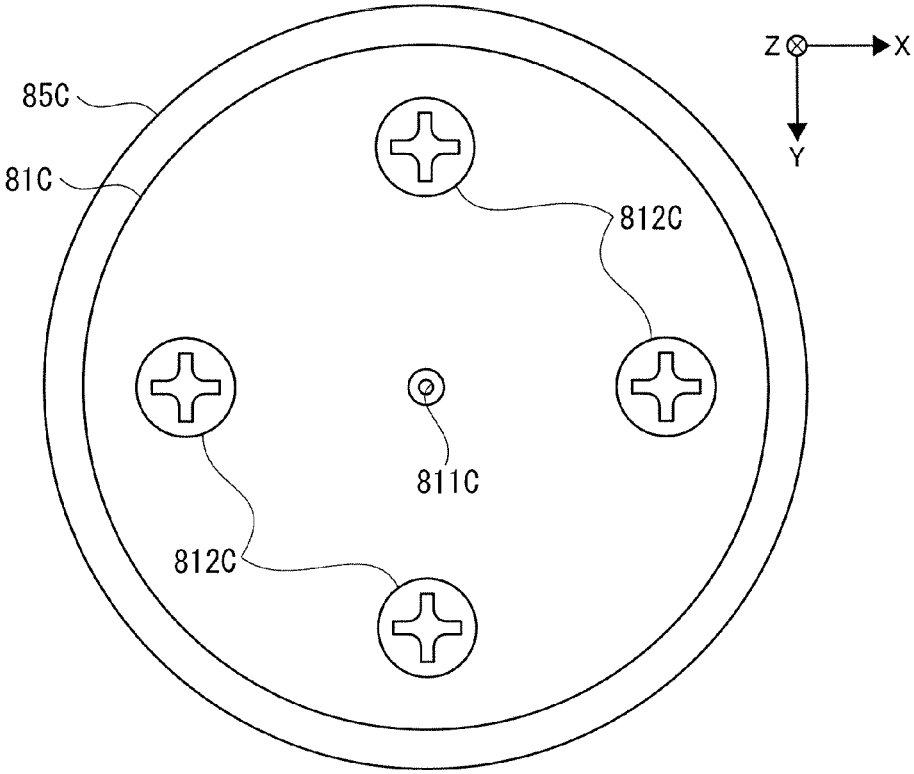
FIG. 9B is a diagram illustrating a target supply device viewed from a −Z direction.
Figure 9C:
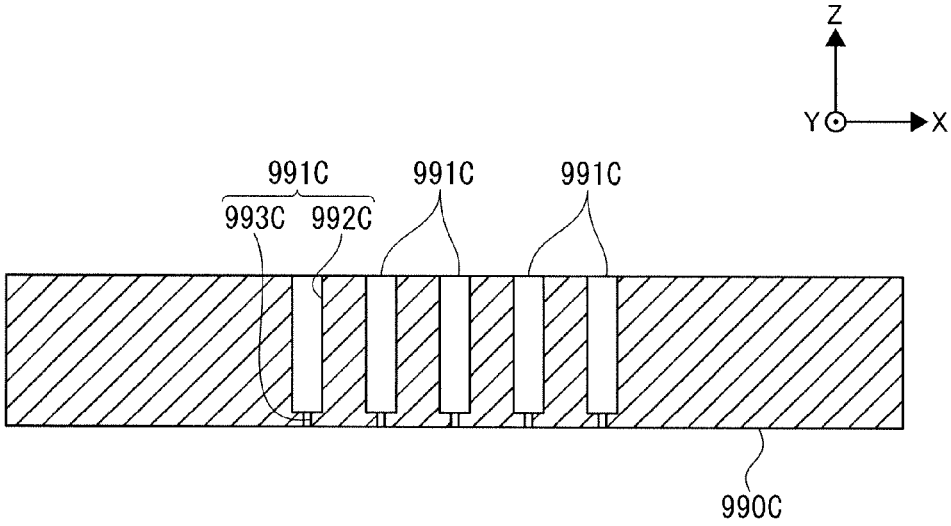
FIG. 9C schematically illustrates the configuration of a filter.

FIG. 7 schematically illustrates the configuration of a target supply device according to the third embodiment. FIG. 8 illustrates a state of attachment of first, second, and third porous filters in the target supply device. FIG. 9A illustrates a state of attachment of the filter in the target supply device. FIG. 9B is a diagram illustrating the target supply device viewed from the −Z direction. FIG. 9C schematically illustrates the configuration of the filter.

As shown in FIG. 7, a target generation section in the target supply device may include a target generator 8C, a first porous filter 754C, a second porous filter 755C, a third porous filter 756C, a holder portion 76C, and a filter 990C.

The target generator 8C may include a tank 82C, a nozzle base end portion 85C, and a nozzle tip portion 81C. The tank 82C, the nozzle base end portion 85C, and the nozzle tip portion 81C may be configured of a material having a low reactivity with the target material 270, such as molybdenum.

The tank 82C may include a tank main body 821C and a cap portion 822C.

The tank main body 821C may be formed in a substantially cylindrical shape having a wall surface in a second surface located on the −Z direction thereof. A hollow portion of the tank main body 821C may serve as a holding space 820C. A heater of a temperature control section (not shown) may be provided on an outer circumferential surface of the tank main body 821C. A recess portion 823C that is recessed in a substantially circular shape in the +Z direction may be provided in the center of a second surface of the tank main body 821C. A second through-hole 824C that communicates with the holding space 820C may be provided in the center of the recess portion 823C. The entire second surface of the tank main body 821C may be polished.

The cap portion 822C may be formed in a substantially circular plate shape that closes off a first surface of the tank main body 821C on the +Z direction side thereof. The pipe 734A may be connected to the center of the cap portion 822C. The cap portion 822C may be anchored to the first surface of the tank main body 821C by a plurality of bolts 826C. Here, a seal may be formed between the tank main body 821C and the cap portion 822C by embedding an O-ring 827C in a groove provided in the first surface of the tank main body 821C.

The nozzle base end portion 85C may be formed as a substantially circular column. An outer diameter of the nozzle base end portion 85C may be substantially the same as an outer diameter of the tank main body 821C. A first protruding portion 851C that resembles the shape of the recess portion 823C in the tank main body 821C may be provided in a first surface of the nozzle base end portion 85C on the +Z direction side thereof. The nozzle base end portion 85C may be anchored to the second surface of the tank main body 821C by bolts 790C, mentioned later, of the holder portion 76C. Here, a seal may be formed between the tank main body 821C and the nozzle base end portion 85C by embedding an O-ring 852C in a groove provided in a first surface of the first protruding portion 851C on the +Z direction side thereof.

As shown in FIGS. 7 and 8, a third through-hole 853C may be provided in the center of the nozzle base end portion 85C so as to pass therethrough in a vertical direction (the Z-axis direction). The third through-hole 853C may communicate with the second through-hole 824C. The +Z direction side of the third through-hole 853C may serve as a housing portion 854C. A main body member 760C, mentioned later, of the holder portion 76C may be housed within the housing portion 854C. The housing portion 854C may include a first contact portion 855C and a second contact portion 856C. The first contact portion 855C may make contact with an outer circumferential surface of the main body member 760C. The second contact portion 856C may make contact with a second surface of the main body member 760C. A surface of the second contact portion 856C that makes contact with the main body member 760C may be polished.

A second protruding portion 857C may be provided in a second surface of the nozzle base end portion 85C on the −Z direction side thereof. The second protruding portion 857C may project in a substantially circular plate shape in the −Z direction. A recess portion 858C that is recessed in a substantially circular shape in the +Z direction may be provided in the center of the second protruding portion 857C. An opening of the third through-hole 853C may be present within the recess portion 858C. The filter 990C may be inserted into the recess portion 858C. An area of the recess portion 858C with which the filter 990C makes contact may be polished.

The nozzle tip portion 81C may be formed as a substantially circular plate, as shown in FIGS. 7, 9A, and 9B. An outer diameter of the nozzle tip portion 81C may be less than the outer diameter of the nozzle base end portion 85C. A recess portion 810C that is recessed in a substantially circular shape in the −Z direction may be provided in the center of a first surface of the nozzle tip portion 81C. The second protruding portion 857C of the nozzle base end portion 85C may fit into the recess portion 810C. At this time, the recess portion 810C may make contact with the filter 990C. An area of the recess portion 810C with which the filter 990C makes contact may be polished. The nozzle tip portion 81C may be anchored to a second surface of the nozzle base end portion 85C by a plurality of bolts 812C that pass through the nozzle tip portion 81C.

A fourth through-hole 813C may be provided in the center of the nozzle tip portion 81C so as to pass therethrough in the vertical direction (the Z-axis direction). The fourth through-hole 813C may communicate with the third through-hole 853C. The fourth through-hole 813C may have a shape in which the diameter dimension thereof decreases toward the −Z direction. An end portion of the fourth through-hole 813C on the −Z direction side thereof may serve as a nozzle hole 811C. The diameter of the nozzle hole 811C may be 6 μm to 15 μm.

A first through-hole according to the present disclosure may be configured by the second through-hole 824C, the third through-hole 853C, and the fourth through-hole 813C.

The first, second, and third porous filters 754C, 755C, and 756C may be the same as the porous filter 75A according to the first embodiment.

Countless fine holes having diameters of, for example, approximately 20 μm may be provided in the first porous filter 754C. Countless fine holes having diameters of, for example, approximately 10 μm may be provided in the second porous filter 755C. Countless fine holes having diameters of, for example, approximately 6 μm may be provided in the third porous filter 756C. In this manner, the sizes of the fine holes may differ among the first porous filter 754C, the second porous filter 755C, and the third porous filter 756C. In addition, the fine holes in the first, second, and third porous filters 754C, 755C, and 756C may pass through the respective porous filters while curving in a variety of directions.

As shown in FIGS. 7 and 8, the first, second, and third porous filters 754C, 755C, and 756C may be held within the third through-hole 853C by the holder portion 76C so as to close off the third through-hole 853C and so as to be stacked in the vertical direction (the Z-axis direction). Here, the first porous filter 754C may be positioned on the +Z direction side, and the third porous filter 756C may be positioned on the −Z direction side. In this manner, the porous filters may be disposed along the direction in which the target material 270 is outputted so that the fine holes in the porous filters become progressively smaller.

The holder portion 76C may include the main body member 760C, the shims 770B, and the bolts 790C serving as an anchoring portion.

The main body member 760C may include the cylinder portion 761A and the contact portion 762A, as shown in FIG. 8. First and second surfaces of the main body member 760C may be polished. The main body member 760C may be housed within the housing portion 854C of the nozzle base end portion 85C.

The shims 770B may be stacked upon a first surface of the first porous filter 754C within the main body member 760C. Two shims 770B, for example, may be stacked within the main body member 760C.

The bolts 790C may pass through the nozzle base end portion 85C and be screwed into the tank main body 821C.

The filter 990C may be provided so as to close off the fourth through-hole 813C on the side distanced from the first, second, and third porous filters 754C, 755C, and 756C in the direction in which the target material 270 is outputted (that is, on the −Z direction side). The filter 990C may collect particles that have passed through the third porous filter 756C and/or particles that have been produced downstream from the third porous filter 756C in the output direction of the target material 270.

The filter 990C may be formed of a material having a low reactivity with the target material 270, as a substantially circular plate. A first surface of the filter 990C on the +Z direction side thereof and a second surface on the −Z direction side thereof may be polished. A difference between the coefficient of linear thermal expansion of the filter 990C and the coefficient of linear thermal expansion of the target generator 8C may be lower than 20% of the coefficient of linear thermal expansion of the target generator 8C. A difference between the coefficient of linear thermal expansion of the filter 990C and the coefficient of linear thermal expansion of the main body member 760C may be lower than 20% of the coefficient of linear thermal expansion of the main body member 760C. The filter 990C may be formed of molybdenum, for example.

As shown in FIG. 9C, a plurality of through-holes 991C may be provided in the filter 990C, passing therethrough in the thickness direction (the Z-axis direction) in straight line shapes. Each through-hole 991C may include a large-diameter portion 992C on a first surface side and a small-diameter portion 993C on a second surface side. The large-diameter portion 992C may be formed through mechanical processing. The diameter of the large-diameter portion 992C may be approximately 100 μm, for example. The small-diameter portion 993C may be formed through discharge processing. The diameter of the small-diameter portion 993C may be approximately 6 μm, for example.

The particle collection amount (capacity) of the through-holes 990C may be lower than the collection amounts (capacities) of the first, second, and third porous filters 754C, 755C, and 756C, respectively.

3.4.3 Operation

3.4.3.1 Assembly of Target Generator

First, the filter 990C may be inserted into the recess portion 858C of the nozzle base end portion 85C. The second protruding portion 857C of the nozzle base end portion 85C may then be inserted into the recess portion 810C of the nozzle tip portion 81C, and the bolts 812C may be screwed into the nozzle base end portion 85C.

The nozzle tip portion 81C can be anchored to the nozzle base end portion 85C with a seal formed between the second surface of the filter 990C and the nozzle tip portion 81C and between the first surface of the filter 990C and the nozzle base end portion 85C by screwing the bolts 812C into the nozzle base end portion 85C in this manner.

Then, after the first, second, and third porous filters 754C, 755C, and 756C have been inserted into the main body member 760C, the two shims 770B may be stacked upon the first porous filter 754C.

Next, the main body member 760C may be housed within the housing portion 854C of the nozzle base end portion 85C. The first protruding portion 851C of the nozzle base end portion 85C may then be fitted into the recess portion 823C of the tank main body 821C. Here, the contact pressure on the first, second, and third porous filters 754C, 755C, and 756C may be adjusted by adjusting the thicknesses of the shims 770B, the number of the shims 770B, and so on, in the same manner as in the second embodiment. Thereafter, the bolts 790C may be screwed into the tank main body 821C.

The first, second, and third porous filters 754C, 755C, and 756C, the main body member 760C, and the shims 770B can be anchored to the tank main body 821C by screwing the bolts 790C into the tank main body 821C in this manner. Here, a seal can be formed between a first surface of the main body member 760C and the tank main body 821C and between the first surface of the shim 770B located on the +Z direction side and the tank main body 821C. Furthermore, a seal can be formed between the shims 770B stacked on each other and between the second surface of the shim 770B located on the −Z direction side and the first surface of the first porous filter 754C. Further still, a seal can be formed between a second surface of the third porous filter 756C and the first surface of the contact portion 762A, and between a second surface of the contact portion 762A and the contact surface of the second contact portion 856C.

The assembly of the target generator 8C can be completed through these operations.

3.4.3.2 Operation of Target Supply Device

In the following, descriptions of operations identical to those in the first embodiment will be omitted.

While solid target material 270 is held within the holding space 820C, the target control apparatus may heat the target generator 8C to a temperature greater than or equal to the melting point of the target material 270. Thereafter, the target control apparatus may adjust the pressure within the target generator 8C to a first pressure.

As a result of the pressure adjustment, the liquid target material 270 can pass through the first porous filter 754C while flowing through the second through-hole 824C and into the third through-hole 853C. The first porous filter 754C can collect particles larger than the diameters of the fine holes in the first porous filter 754C as the target material 270 passes through the first porous filter 754C.

The target material 270 that has passed through the first porous filter 754C can then pass through the second porous filter 755C. The second porous filter 755C can collect particles larger than the diameters of the fine holes in the second porous filter 755C as the target material 270 passes through the second porous filter 755C.

The target material 270 that has passed through the second porous filter 755C can then pass through the third porous filter 756C. The third porous filter 756C can collect particles larger than the diameters of the fine holes in the third porous filter 756C as the target material 270 passes through the third porous filter 756C.

Thereafter, the target material 270 can pass through the filter 990C.

Here, particles may be present in the target material 270 that has reached the filter 990C. These particles can be particles that adhered to the first, second, and third porous filters 754C, 755C, and 756C when the first, second, and third porous filters 754C, 755C, and 756C were formed or were attached to the main body member 760C, as well as particles that the first, second, and third porous filters 754C, 755C, and 756C could not collect. The filter 990C can collect these particles.

The target material 270 that has passed through the filter 990C can flow into the fourth through-hole 813C.

Thereafter, the target control apparatus may adjust the pressure within the target generator 8C to a second pressure and output the target material 270 from the nozzle hole 811C as the targets 27.

Because the holder portion 76C is disposed outside the tank 82C, it is not necessary to provide screw-holes for the bolts 790C within the holding space 820C, and particles can be prevented from arising in the holding space 820C when the holder portion 76C is anchored. In addition, because the bolts 790C do not make contact with the target material 270, particles can be prevented from arising in the holding space 820C.

Furthermore, because the first porous filter 754C having the largest-diameter fine holes is disposed on the upstream (+Z direction) side of the direction in which the target material 270 flows and the third porous filter 756C having the smallest-diameter fine holes is disposed on the downstream (−Z direction) side of the direction in which the target material 270 flows, the first, second, and third porous filters 754C, 755C, and 756C can be suppressed from clogging.

3.5 Fourth Embodiment

3.5.1 Overview

In a target supply device according to a fourth embodiment of the present disclosure, the target generator may include a tank having the holding space and a second through-hole that partially configures the first through-hole, a nozzle base end portion, having a third through-hole that partially configures the first through-hole, that is attached to the tank, and a nozzle tip portion, having a fourth through-hole that partially configures the first through-hole, that is attached to the nozzle base end portion; wherein the porous filter is held by the holder portion within the third through-hole. The holder portion may include a contact portion, provided in the nozzle base end portion, that makes contact with the porous filter on the side of the porous filter located toward the fourth through-hole, a shim that is stacked upon the porous filter on the side of the porous filter located toward the second through-hole, and an anchoring portion that anchors the nozzle base end portion to the tank.

3.5.2 Configuration

Figure 10:
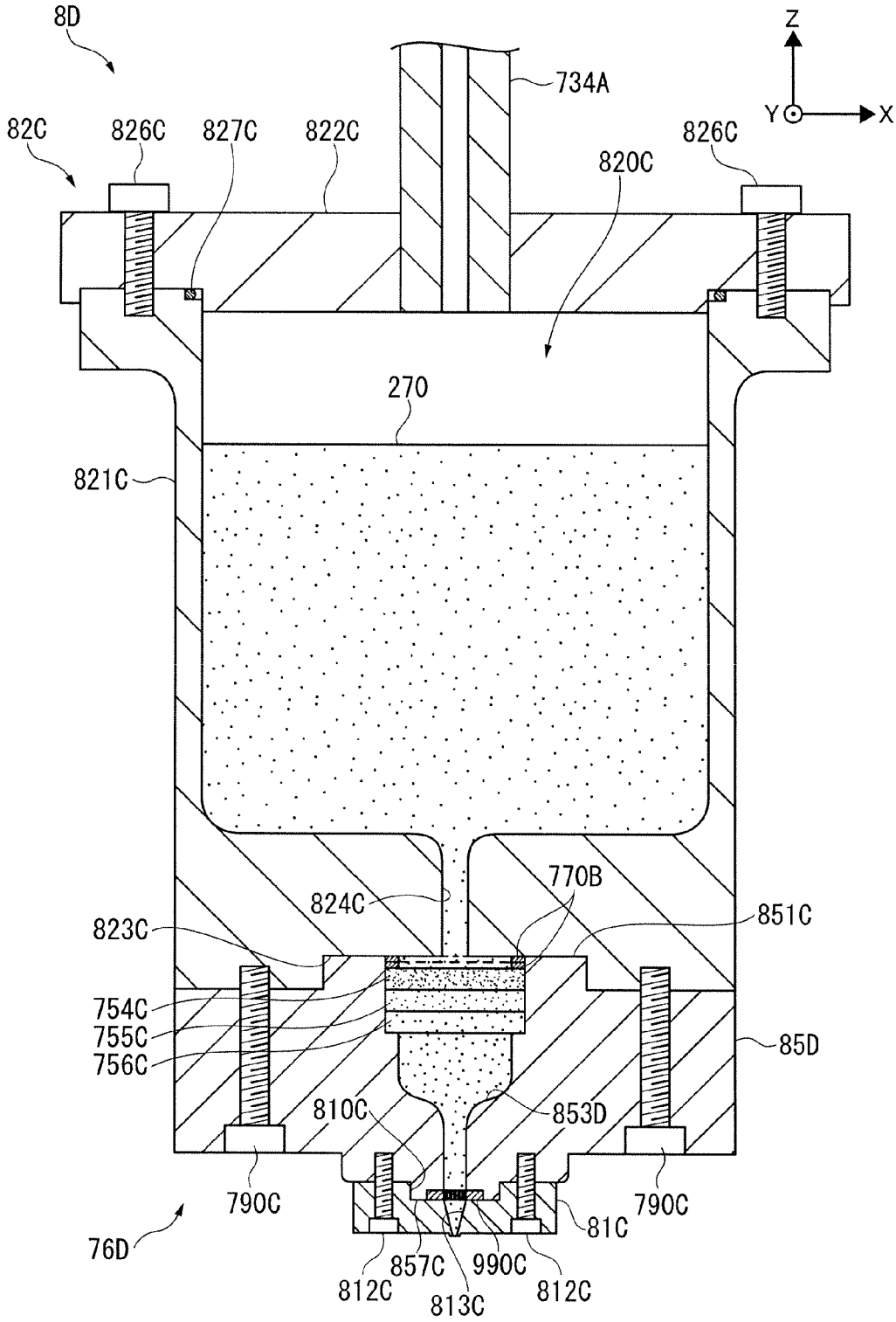
FIG. 10 schematically illustrates the configuration of a target supply device according to a fourth embodiment.
Figure 11:
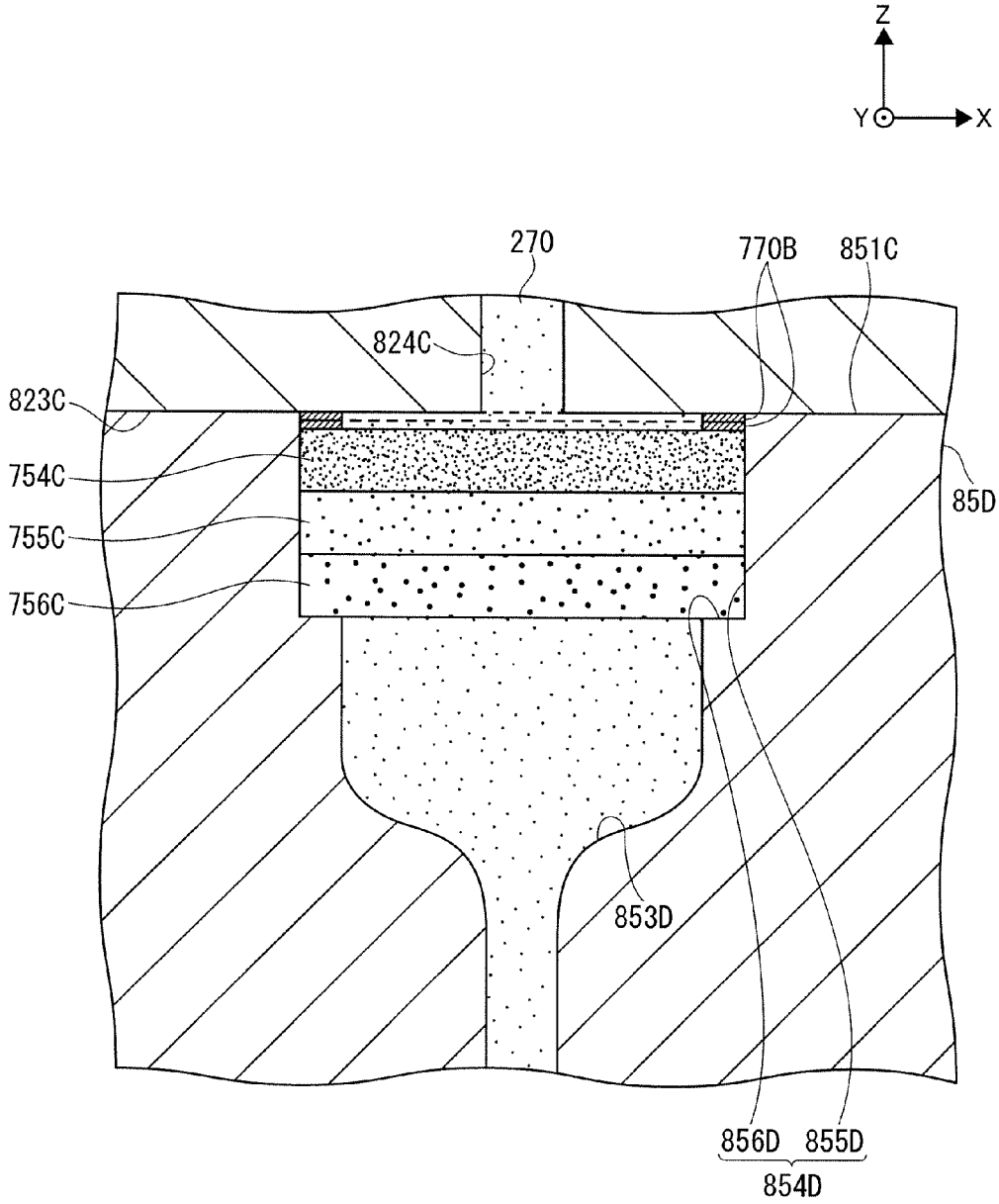
FIG. 11 illustrates a state of attachment of first, second, and third porous filters in a target supply device.

FIG. 10 schematically illustrates the configuration of the target supply device according to the fourth embodiment. FIG. 11 illustrates a state of attachment of first, second, and third porous filters in the target supply device.

As shown in FIG. 10, a target generator 8D of the target supply device may have the same configuration as the target generator 8C according to the third embodiment, with the exception of a nozzle base end portion 85D and a holder portion 76D.

The nozzle base end portion 85D may have the same configuration as the nozzle base end portion 85C according to the third embodiment with the exception of a third through-hole 853D.

The third through-hole 853D may be provided in the center of the nozzle base end portion 85D, passing therethrough in the vertical direction (the Z-axis direction). The third through-hole 853D may communicate with the second through-hole 824C.

The holder portion 76D may include a housing portion 854D, the shims 770B, and the bolts 790C serving as an anchoring portion.

The housing portion 854D may correspond to an area of the third through-hole 853D on the +Z direction side thereof. The first, second, and third porous filters 754C, 755C, and 756C and the shims 770B may be housed within the housing portion 854D. The housing portion 854D may include a first contact portion 855D and a second contact portion 856D. The first contact portion 855D may make contact with outer circumferential surfaces of the first, second, and third porous filters 754C, 755C, and 756C and outer circumferential surfaces of the shims 770B. The second contact portion 856D may make contact with a second surface of the third porous filter 756C. The surface where the second contact portion 856D makes contact with the third porous filter 756C may be polished.

3.5.3 Operation

Next, operations for assembling the target generator will be described.

In the following, descriptions of operations identical to those in the third embodiment will be omitted.

Note also that because operations performed when generating EUV light are the same as those in the third embodiment, descriptions thereof will be omitted.

First, the first, second, and third porous filters 754C, 755C, and 756C may be inserted into the housing portion 854D of the nozzle base end portion 85D after the nozzle tip portion 81C has been anchored to the nozzle base end portion 85D. Next, the two shims 770B may be stacked upon the first porous filter 754C. Thereafter, the nozzle base end portion 85D may be disposed on the second surface of the tank main body 821C, and the bolts 790C may be screwed into the tank main body 821C.

The first, second, and third porous filters 754C, 755C, and 756C and the shims 770B can be anchored to the tank main body 821C by screwing the bolts 790C into the tank main body 821C in this manner. Here, a seal can be formed between the first surface of the shims 770B located on the +Z direction side and the tank main body 821C. Furthermore, a seal can be formed between the shims 770B stacked on each other and between the second surface of the shim 770B located on the −Z direction side and the first surface of the first porous filter 754C. Further still, a seal can be formed between the second surface of the third porous filter 756C and the contact surface of the second contact portion 856D.

The assembly of the target generator 8D can be completed through these operations.

According to the target supply device as described above, the second contact portion 856D of the holder portion 76D is provided as a part of the nozzle base end portion 85D, and thus the number of components can be reduced.

3.6 Fifth Embodiment

3.6.1 Configuration

Figure 12:
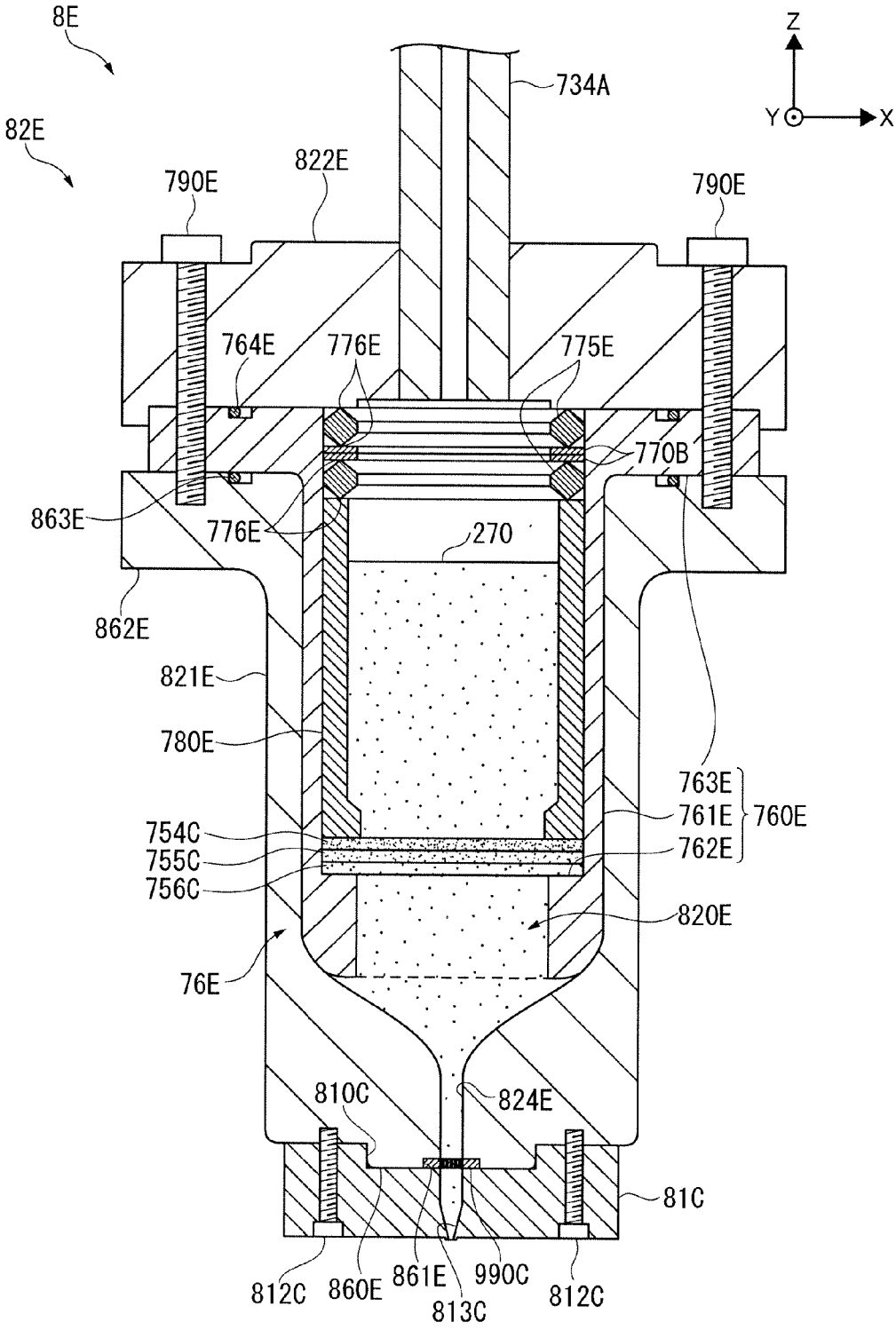
FIG. 12 schematically illustrates the configuration of a target supply device according to a fifth embodiment.

FIG. 12 schematically illustrates the configuration of a target supply device according to the fifth embodiment.

As shown in FIG. 12, a target generation section in the target supply device may include a target generator 8E, the first porous filter 754C, the second porous filter 755C, the third porous filter 756C, a holder portion 76E, and the filter 990C.

The target generator 8E may include a tank 82E and the nozzle tip portion 81C. The tank 82E and the nozzle tip portion 81C may be configured of a material having a low reactivity with the target material 270, such as molybdenum.

The tank 82E may include a tank main body 821E and a cap portion 822E.

The tank main body 821E may be formed in a substantially cylindrical shape having a wall surface on a second surface located in the −Z direction thereof. A hollow portion of the tank main body 821E may serve as a holding space 820E. A heater of a temperature control section (not shown) may be provided on an outer circumferential surface of the tank main body 821E. A protruding portion 860E that protrudes in a substantially circular shape in the −Z direction may be provided in the center of a second surface of the tank main body 821E. A second through-hole 824E may be provided in the center of the protruding portion 860E. A recess portion 861E that is recessed in a substantially circular shape in the +Z direction may be provided in the center of the protruding portion 860E. The entire second surface of the tank main body 821E may be polished. A flange 862E that projects outward may be provided in an end portion of the tank main body 821E on the +Z direction side thereof.

The cap portion 822E may be formed in a substantially circular plate shape that closes off a first surface of the tank main body 821E. The pipe 734A may be connected to the center of the cap portion 822E.

The protruding portion 860E of the tank main body 821E may fit into the recess portion 810C of the nozzle tip portion 81C. At this time, the recess portion 810C may make contact with the filter 990C. The nozzle tip portion 81C may be anchored to the second surface of the tank main body 821E by the plurality of bolts 812C that pass through the nozzle tip portion 81C.

The holder portion 76E may include a main body member 760E, a pressing member 780E, spacers 775E, the shims 770B, and bolts 790E serving as anchoring members.

The main body member 760E may include a cylindrical portion 761E, a contact portion 762E, and a flange 763E. The contact portion 762E may be provided in an end portion of the cylindrical portion 761E on the −Z direction side thereof so as to protrude toward the interior of the cylindrical portion 761E. A first surface of the contact portion 762E on the +Z direction side thereof may be polished. The flange 763E may be provided in an end portion of the cylindrical portion 761E on the +Z direction side thereof so as to protrude outward. The main body member 760E may be disposed within the tank main body 821E so that the flange 763E makes contact with the flange 862E and the cylindrical portion 761E is housed within the holding space 820E.

The first, second, and third porous filters 754C, 755C, and 756C may be stacked within the main body member 760E. Here, the first porous filter 754C may be positioned on the +Z direction side, and the third porous filter 756C may be positioned on the −Z direction side.

The pressing member 780E and the spacers 775E may be formed of a material having a low reactivity with the target material 270. A difference between the coefficient of linear thermal expansion of the pressing member 780E and the spacers 775E and the coefficient of linear thermal expansion of the target generator 8E may be lower than 20% of the coefficient of linear thermal expansion of the target generator 8E. The pressing member 780E and the spacers 775E may be formed of molybdenum, for example. Note that the pressing member 780E and the spacers 775E may be formed of different materials.

The pressing member 780E may be formed in a substantially cylindrical shape whose inner diameter dimension is substantially the same as an outer diameter dimension of the cylindrical portion 761E. A second surface of the pressing member 780E on the −Z direction side thereof may be polished.

The pressing member 780E may be housed within the main body member 760E. Here, the pressing member 780E may make contact with the first surface of the first porous filter 754C and an inner surface of the cylindrical portion 761E.

The spacers 775E may be formed in a substantially circular ring-shape. An outer diameter and an inner diameter of the spacers 775E may be substantially the same as the outer diameter and the inner diameter of the shims 770B, respectively. The spacers 775E may have a substantially hexagonal shape when viewed as a vertical cross-section.

For example, two spacers 775E and two shims 770B may be disposed within the main body member 760E, on the +Z direction side of the pressing member 780E.

One of the spacers 775E may be disposed so that a corner portion 776E on the −Z direction side of the substantially hexagonal shape makes line contact with a first surface of the pressing member 780E on the +Z direction side thereof.

The two shims 770B may be stacked upon the one spacer 775E. Here, the corner portion 776E on the +Z direction side of the one spacer 775E may make line contact with the second surface of the shim 770B located on the −Z direction side.

The other spacer 775E may be disposed so that the corner portion 776E on the −Z direction side makes line contact with the first surface of the shim 770B located on the +Z direction side thereof. Furthermore, the other spacer 775E may be disposed so that the corner portion 776E on the +Z direction side makes line contact with a second surface of the cap portion 822E.

The bolts 790E may pass through the cap portion 822E and the flange 763E of the main body member 760E and be screwed into the flange 862E of the tank main body 821E. Here, a seal may be formed between the cap portion 822E and the main body member 760E and between the main body member 760E and the tank main body 821E by embedding an O-ring 764E and an O-ring 863E in grooves formed in a first surface of the flange 763E and a first surface of the flange 862E, respectively.

3.6.2 Operation

Next, operations for assembling the target generator will be described.

Note also that because operations performed when generating EUV light are the same as those in the third embodiment, descriptions thereof will be omitted.

First, the filter 990C may be inserted into the recess portion 861E of the tank main body 821E and the nozzle tip portion 81C may be anchored to the tank main body 821E using the bolts 812C. A seal can be formed between the second surface of the filter 990C and the nozzle tip portion 81C and between the first surface of the filter 990C and the tank main body 821E as a result of this anchoring.

Then, after the first, second, and third porous filters 754C, 755C, and 756C have been inserted into the main body member 760E, the one spacer 775E, the two shims 770B, and the other spacer 775E may be stacked thereupon.

Next, the main body member 760E may be inserted into the holding space 820E of the tank main body 821E. Thereafter, the cap portion 822E may be disposed on the main body member 760E and the bolts 790E may be screwed into the flange 862E of the tank main body 821E.

The first, second, and third porous filters 754C, 755C, and 756C, the main body member 760E, the shims 770B, the spacers 775E, and the pressing member 780E can be anchored to the tank main body 821E by screwing the bolts 790E into the flange 862E in this manner. Here, a seal can be formed between a second surface of the tank 82E and the other spacer 775E and between the first surface of the shim 770B located on the +Z direction side and other spacer 775E. Furthermore, a seal can be formed between the shims 770B stacked on each other and between the second surface of the shim 770B located on the −Z direction side and the one spacer 775E. Further still, a seal can be formed between the one spacer 775E and a first surface of the pressing member 780E and between a second surface of the pressing member 780E and the first surface of the first porous filter 754C. Finally, a seal can be formed between the second surface of the third porous filter 756C and the contact surface of the contact portion 762E.

The assembly of the target generator 8E can be completed through these operations.

According to the fifth embodiment as described thus far, the spacer 775E and the cap portion 822E, the spacers 775E and the shims 770B, and the spacer 775E and the pressing member 780E make line contact with each other, and thus contact pressure at the locations of contact can be ensured with ease.

3.7 Variations

Note that the following configurations may be employed as the target supply device.

Two or more porous filters may be provided in the first and second embodiments. Likewise, one, two, or four or more porous filters may be provided in the third to fifth embodiments.

One, two, or four or more shims 770B may be provided in the second embodiment. Likewise, one or three or more shims 770B may be provided in the third to fifth embodiments.

A laser processing technique or a microfabrication technique used in semiconductor processes or the like may be used as the method for forming the through-holes 991C in the filter 990C according to the third to fifth embodiments.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device comprising:

a target generator having a holding space and a first through-hole that communicates with the holding space;

a porous filter having a thermal expansion coefficient that is substantially the same as a thermal expansion coefficient of the target generator; and a holder portion, having a thermal expansion coefficient that is substantially the same as the thermal expansion coefficient of the target generator, configured to hold the porous filter and provided so as to form a seal against an inner surface of the target generator.

2. The target supply device according to claim 1, wherein the porous filter is held by the holder portion so as to oppose an opening of the first through-hole within the holding space; and wherein the holder portion includes:

a first member provided between the porous filter and the target generator so as to surround the opening of the first through-hole;

a shim that is stacked upon the porous filter;

a second member provided so as to sandwich the porous filter and the shim between the first member and the second member; and an anchoring portion configured to anchor the first member, the second member, and the target generator together.

3. The target supply device according to claim 1, wherein the target generator includes:

a tank having the holding space and a second through-hole that partially configures the first through-hole;

a nozzle base end portion, having a third through-hole that partially configures the first through-hole, that is attached to the tank; and a nozzle tip portion, having a fourth through-hole that partially configures the first through-hole, that is attached to the nozzle base end portion;

wherein the porous filter is held by the holder portion within the third through-hole; and wherein the holder portion includes:

a main body member, formed in an substantially cylindrical shape so as to fit with the third through-hole and internally house the porous filter, having a contact portion that makes contact with the porous filter on the side of the porous filter located toward the fourth through-hole;

a shim that is stacked upon the porous filter on the side of the porous filter located toward the second through-hole; and an anchoring portion configured to anchor the nozzle base end portion to the tank.

4. The target supply device according to claim 1, wherein the target generator includes:

a tank having the holding space and a second through-hole that partially configures the first through-hole;

a nozzle base end portion, having a third through-hole that partially configures the first through-hole, that is attached to the tank; and a nozzle tip portion, having a fourth through-hole that partially configures the first through-hole, that is attached to the nozzle base end portion;

wherein the porous filter is held by the holder portion within the third through-hole; and wherein the holder portion includes:

a contact portion, provided in the nozzle base end portion, that makes contact with the porous filter on the side of the porous filter located toward the fourth through-hole;

a shim that is stacked upon the porous filter on the side of the porous filter located toward the second through-hole; and an anchoring portion configured to anchor the nozzle base end portion to the tank.

5. The target supply device according to claim 1, further comprising:

a filter, having a thermal expansion coefficient that is substantially the same as the thermal expansion coefficient of the target generator, provided on the opposite side of the porous filter to the side on which the holding space is located.

6. The target supply device according to claim 1, wherein the porous filter is formed of a porous glass whose raw material is shirasu.

* * * * *